US009365393B2

(12) United States Patent
Salmikuukka et al.

(10) Patent No.: US 9,365,393 B2
(45) Date of Patent: Jun. 14, 2016

(54) CONVEYING SYSTEM HAVING A DETECTION AREA

(71) Applicant: KONE Corporation, Helsinki (FI)

(72) Inventors: Jukka Salmikuukka, Espoo (FI); Mirva Nevalainen, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 457 days.

(21) Appl. No.: 13/919,779

(22) Filed: Jun. 17, 2013

(65) Prior Publication Data

US 2013/0277153 A1 Oct. 24, 2013

Related U.S. Application Data

(63) Continuation of application No. PCT/FI2011/051151, filed on Dec. 23, 2011.

(30) Foreign Application Priority Data

Dec. 30, 2010 (FI) ..... 20106386

(51) Int. Cl.
*B66B 1/20* (2006.01)
*B66B 1/34* (2006.01)
*B66B 1/46* (2006.01)

(52) U.S. Cl.
CPC ..... *B66B 1/3461* (2013.01); *B66B 1/468* (2013.01); *B66B 2201/4653* (2013.01)

(58) Field of Classification Search
CPC ..... B66B 1/3461; B66B 1/468; B66B 2201/4653
USPC ..... 187/247, 380–389, 391–393
See application file for complete search history.

(56) References Cited

U.S. PATENT DOCUMENTS 6,257,373 B1 * 7/2001 Hikita ..... B66B 1/2458 187/387
6,357,554 B1 3/2002 Valk et al.
6,707,374 B1 * 3/2004 Zaharia ..... B66B 1/468 187/392
7,140,469 B2 * 11/2006 Deplazes ..... B66B 1/3476 187/316
7,190,256 B2 * 3/2007 Pieper ..... B66B 1/468 340/5.2
7,581,622 B2 * 9/2009 Amano ..... B66B 1/18 187/384
8,020,672 B2 * 9/2011 Lin ..... B66B 1/34 187/316
8,061,485 B2 * 11/2011 Finschi ..... B66B 1/468 187/384

(Continued)

FOREIGN PATENT DOCUMENTS

EP 2 295 361 A1 3/2011
WO WO 01/07353 A1 2/2001

(Continued)

*Primary Examiner* — Anthony Salata
(74) *Attorney, Agent, or Firm* — Birch, Stewart, Kolasch & Birch, LLP

(57) ABSTRACT

A conveying system and a method for registering service requests in a conveying system, including at least one transport device, is provided. A detection area bounded on a floor surface is in connection with the transport device, in which detection area the identification data contained in the personal identifiers of passengers is read. The service profiles of passengers who have arrived in the detection area and/or who have left the detection area are determined on the basis of the identification data, and a service request according to the service profiles is registered for transporting and/or admitting passengers in the detection area to the location indicated by the service request.

17 Claims, 2 Drawing Sheets

(56) References Cited

U.S. PATENT DOCUMENTS

Figure 1:
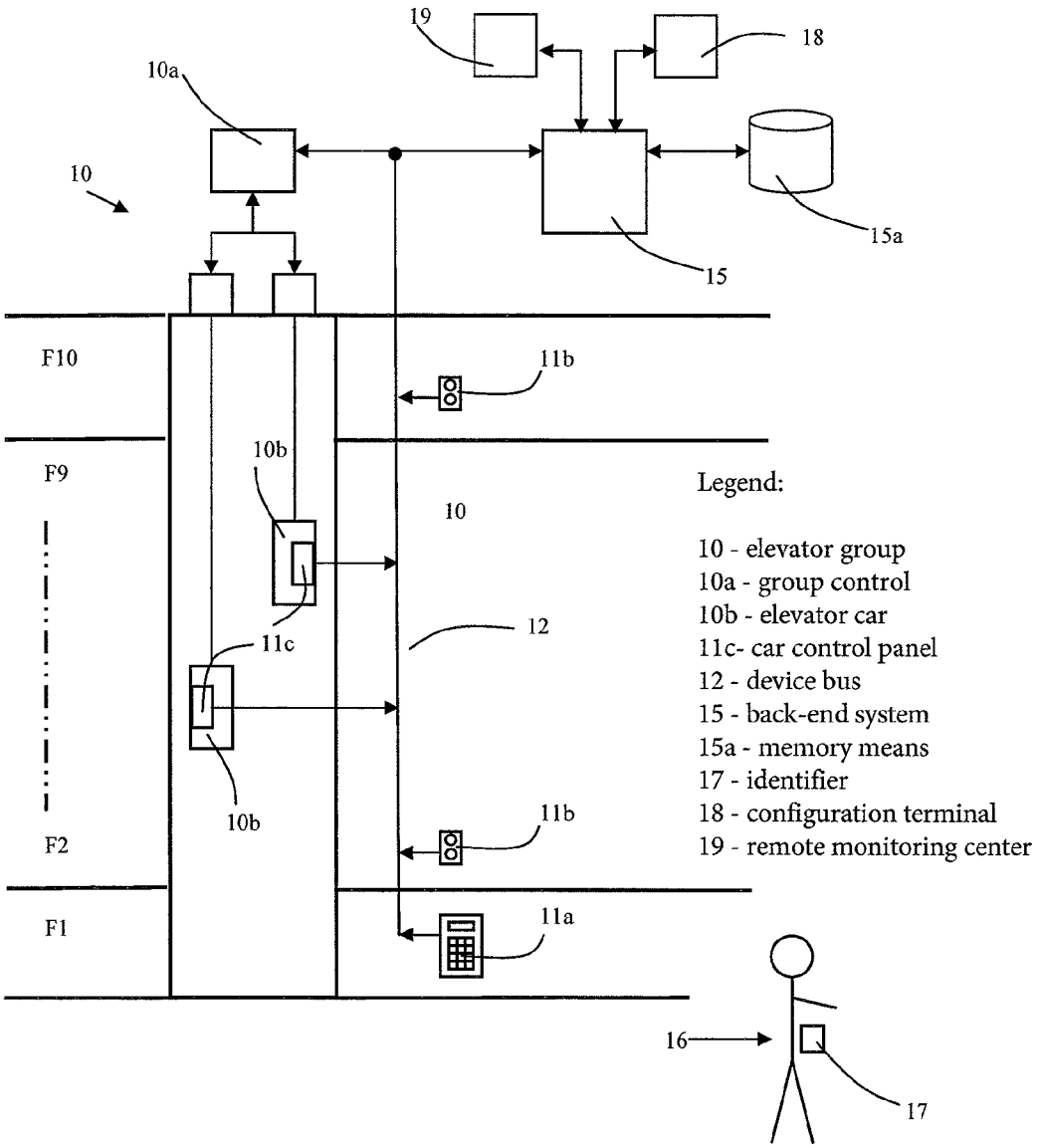

| | | | | |
|---|---|---|---|---|
| 8,464,840 | B2 * | 6/2013 | Flynn | B66B 1/468 187/384 |
| 8,490,754 | B2 * | 7/2013 | Amano | B66B 1/2458 187/384 |
| 8,544,612 | B2 * | 10/2013 | Korhonen | B66B 1/468 187/387 |
| 8,857,569 | B2 * | 10/2014 | Friedli | B66B 5/0012 187/384 |
| 8,944,219 | B2 * | 2/2015 | Gerstenkorn | B66B 1/468 187/384 |
| 2008/0217112 | A1 | 9/2008 | Puskala et al. | |
| 2012/0305341 | A1 * | 12/2012 | Kuoppala | B66B 1/468 187/382 |
| 2014/0231185 | A1 * | 8/2014 | Salmikuukka | B66B 1/2458 187/384 |
| 2015/0068850 | A1 * | 3/2015 | Mattsson | B66B 1/3476 187/392 |
| 2015/0096843 | A1 * | 4/2015 | Siddiqui | B66B 1/2416 187/380 |
| 2015/0114763 | A1 * | 4/2015 | Kim | B66B 5/0012 187/392 |

FOREIGN PATENT DOCUMENTS

| | | | |
|---|---|---|---|
| WO | WO 2007/026042 | A2 | 3/2007 |
| WO | WO 2008/116963 | A1 | 10/2008 |
| WO | WO 2008/120849 | A1 | 10/2008 |
| WO | WO 2010/004607 | A1 | 1/2010 |

* cited by examiner

Legend:

11b - call panel
11d - call panel
22c - load weighing device
22d- load weighing device
23a - detection area
23b - detection area
23c - detection area
23d - detection area

CONVEYING SYSTEM HAVING A DETECTION AREA

CROSS REFERENCE TO RELATED APPLICATIONS

This application is a Bypass Continuation of PCT International Application No. PCT/FI2011/051151 filed on Dec. 23, 2011, which claims priority under 35 U.S.C §119(a) to Patent Application No. 20106386 filed in Finland on Dec. 30, 2010, all of which are hereby expressly incorporated by reference into the present application.

FIELD OF THE INVENTION

The invention relates to conveying systems. More particularly the invention relates to the registration of service requests in elevator systems and other such conveying systems by means of a personal identifier.

BACKGROUND OF THE INVENTION

With regard to elevator systems, call-giving solutions are known in which a passenger gives calls to the elevators of an elevator system by means of a personal identifier, e.g. by means of an RFID identifier (Radio Frequency Identifier). For reading the data contained in an identifier, the elevator system must be provided with reader devices, into the detection area of which a passenger must take an identifier in his/her possession. The reader devices of identifiers that are remotely read can be disposed e.g. in elevator lobbies at a distance from the elevators, whereas the reader devices of identifiers that are read from close range are often disposed in connection with call panels in elevator lobbies or elevator cars. On the basis of the data read from identifiers, the elevator system can generate e.g. a destination call to a floor identified by the data. Solutions are also known in which a passenger is identified from a fingerprint or from some other bio-identifier instead of an electronically readable identifier. Often access control is connected to the aforementioned solutions such that for each passenger a service profile is determined for the elevator system or for a special access control system, in which service profile data about those floors or rooms of the building to which the passenger has an access right is recorded.

A number of drawbacks are, however, connected to the prior-art solutions described above. Systems based on bio-identifiers are often unreliable and slow systems for use in elevator systems and other such conveying systems. A so-called crosstalk problem, on the other hand, wherein an identifier in the possession of a passenger is simultaneously detected by two or more reader devices e.g. disposed on different floors, is connected to remotely-read identifiers. This easily leads to the registration of erroneous elevator calls or of other service requests. To minimize the crosstalk problem, reader devices must be located in a building with particular care and accuracy, which of course raises costs. Remotely-read identifiers can also produce useless elevator calls when a passenger arriving in an elevator lobby does not want to use the elevators but instead calls into an elevator lobby for some other reason. The use of identifiers to be read from close range, on the other hand, requires that the passenger takes out the identifier in his/her possession and takes it "manually" to the reader device, which is impractical and slows down travel.

AIM OF THE INVENTION

The aim of the present invention is to eliminate or at least to alleviate said drawbacks that occur in prior-art solutions. The aim of the invention is also to achieve one or more of the following objectives:

- a reliable and user-friendly solution for the giving of elevator calls and of other service requests in conveying systems,
- to reduce the amount of erroneous or accidentally given service requests,
- to improve access control in buildings,
- a conveying system, which both regular passengers and casual visitors can use, and
- a conveying system with functions that can be personalized for specific passengers.

SUMMARY OF THE INVENTION

The method for registering service requests in a conveying system, which comprises at least one transport device, and at least one detection area bounded on a floor surface, in which detection area the identification data contained in the personal identifiers of passengers can be read, wherein the method includes reading the identification data contained in the identifiers of passengers in the detection area, determining the service profiles of passengers who have arrived in the detection area and/or who have left the detection area on the basis of the identification data, and registering a service request according to the determined service profiles for transporting and/or admitting one or more passengers in the detection area to the location served by the conveying system. The conveying system, which includes a back-end system, at least one transport device, and at least one detection area bounded on a floor surface, said detection area comprising a device configured to read and transmit, at least to the back-end system, the identification data of identifiers in the possession of passengers in the detection area, wherein the conveying system is arranged to determine the service profiles of passengers who have arrived in the detection area and/or who have left the detection area on the basis of the identification data, and to register a service request according to the service profiles for transporting and/or admitting one or more passengers to the location served by the conveying system. Other embodiments of the invention are characterized by what is disclosed in the other claims. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the scope of the basic inventive concept in conjunction with other embodiments.

The present invention discloses a method for registering service requests in a conveying system, which comprises at least one transport device, and at least one detection area bounded on a floor surface, in which detection area the identification data contained in the personal identifiers of passengers is read. The service profiles of passengers who have arrived in the detection area and/or who have left the detection area are determined on the basis of the identification data, and a service request according to the service profiles is registered for transporting and/or admitting the one or more aforementioned passengers to the location indicated by the service request.

The present invention also discloses a conveying system, which comprises a back-end system, at least one transport device, and at least one detection area bounded on a floor surface, in connection with which are means for reading and transmitting to a back-end system the identification data contained in the personal identifiers of passengers in the detection area. The back-end system is arranged to determine, on the basis of the identification data, the service profiles of passengers who have arrived in the detection area and/or who have left the detection area, and to register a service request for transporting and/or admitting the one or more aforementioned passengers to the location indicated by the service request.

The term "conveying system" refers in this context to a system in a building, which system comprises a transport device suited for the transportation or guidance of one or more persons, such as e.g. an elevator, an elevator group, an escalator, a travelator, an automatic door or a turnstile. A service request is a request given for controlling one or more transport devices, e.g. an elevator call and/or a request for opening an automatic door or a turnstile. The term "building" refers to a bounded space in which a conveying system is disposed, e.g. an office building, a residential building, a passenger ship, a hotel, a building complex formed by airport terminals, et cetera. A service request is generated either automatically or manually. The term "automatic service request" refers to a service request which the conveying system, or a system in connection with it, automatically generates. The term "manual service request" refers to a service request given by a passenger using a user interface that is in connection with the conveying system, said interface being e.g. a call panel of an elevator.

In one embodiment of the invention the user interface of a transport device is configured dynamically on the basis of determined service profiles. As a result of the embodiment, travel can be facilitated e.g. by personalizing user interfaces for specific passengers. Also access control can be improved by taking into account in the user interfaces the access rights of one or more passengers.

In one embodiment of the invention passengers without an identifier, who have arrived in the detection area and/or who have left the detection area, are detected and a predefined general service profile is set as their service profile. Passengers without an identifier can be detected by providing the detection area with a sensor system e.g. with an optical sensor system, suited to the purpose. In a general service profile the access rights to public locations of a building (floors, restricted spaces) can be set but access to other locations belonging to the access control domain can be prevented. As a result of the embodiment, travel can be facilitated because a personal identifier does not necessarily need to be given to casual visitors.

In one embodiment of the invention the access rights of a passenger, who has arrived in a detection area, to locations served by the transport device are determined and if there are no access rights, an access control alarm is generated. Correspondingly, in another embodiment of the invention the access rights of a passenger, who has left a detection area, to a location served by the transport device is determined and if there is no access right, an access control alarm is generated. An access control alarm can be generated with a notification device suited to the purpose locally where any access rights are "infringed", e.g. in an elevator lobby or in an elevator car. An access control alarm can also be sent to a remote monitoring center, where any actions required by the access control alarm can be decided.

In one embodiment of the invention the access rights of a superpassenger is set for at least one passenger to one or more locations served by the conveying system. Passengers that are in the company of the superpassenger in the detection area can be transported and/or admitted to locations served by the conveying system without the necessary access rights. As a result of the embodiment, travel is facilitated because e.g. casual visitors in the company of the "host" of the visit can be admitted to locations belonging to the access control domain without the visit generating an access control alarm.

With the solution according to the invention numerous advantages are achieved compared to prior-art solutions. The solution according to the invention is simple and easy to integrate into connection with a conveying system. Identifiers are read only when a passenger is in a detection area, in which case identification is accurate and registration of erroneous or accidental calls is avoided. The solution according to the invention is also user-friendly because the identifier does not need to be taken out for giving a service request, but instead the passenger can keep his/her identifier e.g. in his/her pocket when moving around in the building. The user interfaces and the transport services of the conveying system can also be personalized to specific passengers, which facilitates and speeds up the arrival of a passenger at his/her destination. With the solution according to the invention access control can be improved because the transfer of passengers from one location to another can be monitored better than before and e.g. "tail-gating" can be detected, in which tail-gating a passenger follows a second passenger to a location to which the second passenger has an access right but the follower does not.

LIST OF FIGURES

Figure 2:
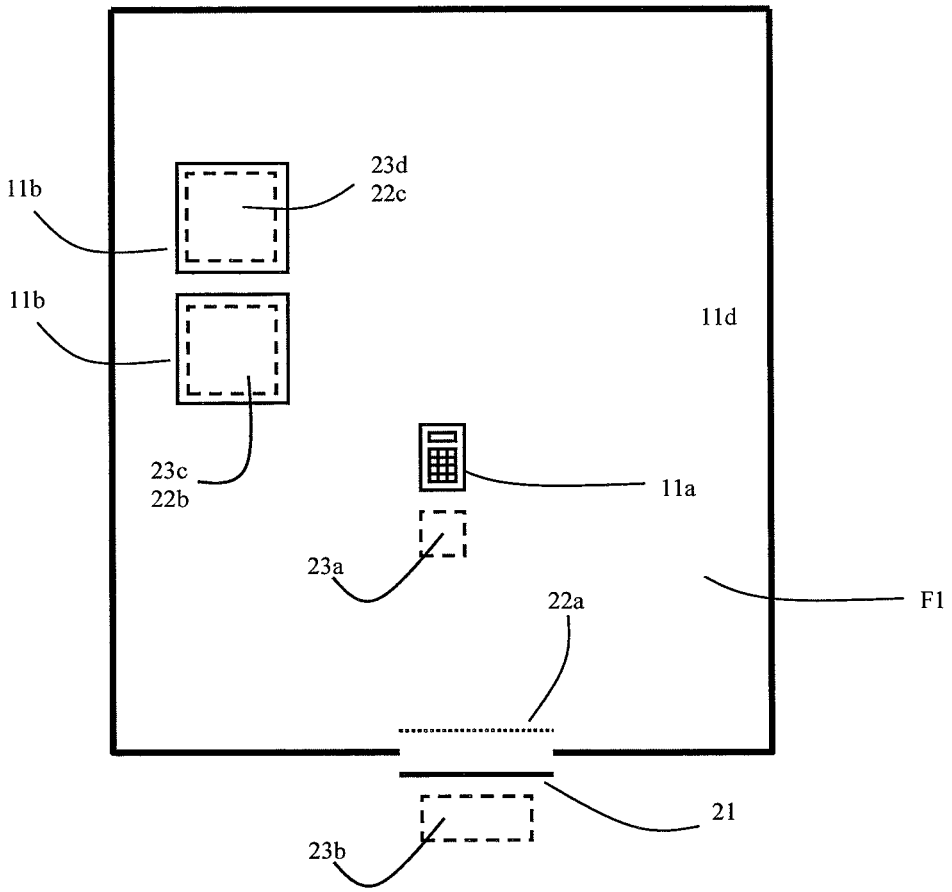

In the following, the invention will be described in detail by the aid of examples of its embodiments, wherein:

FIG. 1 presents one conveying system according to the invention,

FIG. 2 presents a second conveying system according to the invention.

DETAILED DESCRIPTION OF THE INVENTION

FIG. 1 presents one conveying system according to the invention, wherein an elevator group 10 serves the floors F1-F10 of a building. The elevator group comprises two elevators, up/down call pushbuttons 11*b* on the floors F2-F10 for calling an elevator car 10*b* to a call floor, a destination call panel 11*a* for giving destination calls in the entrance lobby floor F1, and car command panels 11*c* for giving car commands in the elevator cars 10*b*. The call panels 11 (11*a*-11*d*) that function as the user interfaces of an elevator group are connected to a device bus 12, via which the back-end system 15, the group control 10*a* of the elevator group and the call panels 11 can transmit data to each other. The device bus 12 can be any data transfer bus whatsoever suited to the purpose, e.g. a wireless local area network. The group control 10*a* and the back-end system 15 form the control system of the conveying system.

The back-end system 15 comprises a processor unit, application software to be run in the processor unit, and also a memory means 15*a*, in which the service profiles of the identifiers 17 in the possession of passengers are recorded. A service profile determines e.g. the floors for which the holder of an identifier 17 (passenger) has an access right, a default floor, on the basis of which an elevator for traveling to the aforementioned default floor can be automatically ordered for a passenger, information about the personal limitations of a passenger, such as about a physical handicap or visual impairment, et cetera. Also information about the period of validity of access rights, within which period a passenger can use his/her identifier for giving service requests, can be connected to a service profile. Individual identification data (an ID number), for example, is recorded in each identifier, on the basis of which identification data the identifier can be connected to a corresponding service profile. The data connected to service profiles is entered and recorded in the memory means 15*a* of the back-end system e.g. by the aid of a configuration terminal 18.

The conveying system contains a plurality of detection areas 23, which are illustrated in FIG. 2, for reading the identification data contained in an identifier 17. FIG. 2 presents the entrance lobby floor F1 of a building according to FIG. 1, said floor comprising an automatic door 21 via which people arriving in the building are admitted to the entrance lobby and can leave it. In front of an automatic door 21 is a detection area 23*b*, in connection with a destination call panel is a detection area 23*a*, and in the elevator cars are car-specific detection areas 23*c* and 23*d*. Each detection area comprises a so-called detection mat and also a reader device (not presented in the figures) connected to the detection mat. When a passenger steps onto the detection mat (detection area 23*b*), the reader device in connection with the detection mat reads the identification data of the identifier 17, e.g. the ID number of the identifier, in the possession of the passenger 16. Transfer technology that is per se prior art is applied in respect of the identification data, in which technology the resistive and/or capacitive properties of the human body are utilized. The transfer technology in question is presented e.g. in publication EP0843425, to which reference is made in this context. A particular advantage of the solution is that a passenger does not need to take his/her identifier device out but instead he/she can keep it, e.g. in a pocket, when in the detection area. The reader device transmits the identification data read, and also, if necessary, the data identifying the detection area, to the back-end system 15, e.g. via a device bus 12. In this way the back-end system can identify a passenger 16 and also where he/she is in the building.

The back-end system 15 determines a service profile for each passenger who has arrived in a detection area. When a passenger arrives e.g. at a destination call panel 11*a* in the entrance lobby, the reader device connected to the detection mat of the detection area 23*a* reads the ID number of the identifier 17 in the pocket of the passenger and transmits said ID number to the back-end system 15. On the basis of the ID number the back-end system determines the service profile of the passenger and, further, the access rights of the passenger to the floors to which he/she can travel with the elevators of the elevator group 10. The back-end system configures the destination call panel 11*a* such that the passenger can give destination calls only for those floors to which he/she has an access right. The group control 10*a* registers the destination call given by the passenger 16 with the destination call panel 11*b* and allocates an elevator car 11*b* for taking the passenger from the entrance lobby to the floor according to the call. The information about the elevator car serving the passenger is transmitted to the display means in connection with the destination call panel 11*a* and also to the back-end system 15. When the allocated elevator car 11*b* arrives at the entrance lobby floor F1 and the passenger transfers into it, the passenger is detected again in the detection area 23*c* or 23*d* of the elevator car. If the back-end system detects that the passenger has gone into the wrong elevator car, the back-end system generates an access control alarm and/or informs, e.g. auditively, the passenger who arrived in the elevator car about the wrong elevator car. Alternatively, the back-end system can send information about the wrong elevator car to the group control 10*a*, which re-allocates the call given by the passenger to that elevator car in which the passenger is.

An example is presented below in which a casual visitor arrives in a building to meet person A who works in the building. Person A has an identifier 17, in the service profile of which A has been granted the access rights of a superuser to floor F5. The visitor notifies A of his/her arrival in the entrance lobby of the building, from where A arrives to collect the visitor. Person A and the visitor transfer into the elevator car 11*b*. The identification data contained in the identifier of person A is read in the elevator car and transmitted to the back-end system in the manner presented earlier. Simultaneously the load-weighing signal of the load weighing device 22*b* or 22*c* in the elevator car 11*b* indicates that two people arrived in the elevator car, which information is also transmitted to the back-end system 15. On the basis of the information the back-end system deduces that one person without an identifier and one person with an identifier 17 arrived in the elevator car. The back-end system 15 sets the service profile of person A and also the service profile of the visitor, which in this case is a general service profile. After the elevator car has taken the passenger to floor F5, both person A and the visitor exit from the elevator car. On the basis of the measuring data of the load weighing device, two people exited from the elevator car, of whom one was person A because the identifier of A is no longer identified in the detection area (23*c* or 23*d*) of the elevator car 11*b*. The back-end system verifies that the passenger A who exited from the elevator car has the access rights of a superuser to floor F5, so that the exiting of the visitor from the elevator car onto floor F5 does not cause an access control alarm although, on the basis of the general service profile, the visitor does not have an access right to floor F5.

In the conveying system according to FIG. 2, the automatic door 21 leading to the entrance lobby of the building is connected as a part of the access control of the building, owing to which a passenger trying to enter the building must have an identifier 17, on the basis of which his/her access rights to the building can be verified. When the passenger arrives in the detection area 23*b*, the back-end system 15 determines, on the basis of the identification data contained in the identifier, the service profile and further the access right of the passenger to the entrance lobby F1 of the building. If the access right is valid, the back-end system sends an opening command to the automatic door for admitting the passenger into the entrance lobby F1. If a default floor is also set in the service profile, the back-end system sends to the group control 10*a* a destination call for collecting the passenger from the entrance lobby and taking said passenger to the default floor in question. If in connection with the opening of an automatic door it is detected that some other passenger goes into the entrance lobby with the same opening of the automatic door without the necessary access right (so-called tail-gating), the back-end system sends an access control alarm e.g. to a remote monitoring center 19 and also temporarily prevents travel use of the elevator group 10 from the entrance lobby to other floors. Tail-gating can be detected e.g. such that some second person, who does not have the necessary access right to the entrance lobby, is simultaneously identified in the detection area 23*b* and/or a sensor, e.g. an optical curtain-of-light 22*a*, is in connection with the automatic door 21, which sensor is able to detect the arrival of more than one passenger in the entrance lobby.

Although the invention is described above using elevator systems as examples, it is obvious to the person skilled in the art that different embodiments of the invention are not only limited to the examples described above, but that they may be varied within the scope of the claims presented below. Thus, for example, the back-end system can be integrated at least partly into the control systems of the transport devices and/or the identifiers can be provided with a suitable memory means in which at least some of the data of the service profiles is recorded. In this case a centralized back-end system is not necessarily needed, but instead the access control can be distributed in the transport devices and decisions relating to service requests can be made by a specific transport device.

The invention claimed is:

1. A method for registering service requests in a conveying system, which comprises at least one transport device, and at least one detection area bounded on a floor surface of the at least one transport device, in which detection area the identification data contained in the personal identifiers of passengers can be read, wherein the method comprises the steps of:

reading the identification data contained in the identifiers of passengers in the detection area;

determining the service profiles of passengers who have arrived in the detection area and/or who have left the detection area on the basis of the identification data; and registering a service request according to the determined service profiles for transporting and/or admitting one or more passengers in the detection area to the location served by the conveying system.

2. The method according to claim 1, wherein the user interface in connection with a transport device is configured dynamically on the basis of the one or more service profiles.

3. The method according to claim 1, wherein passengers without an identifier who have arrived in the detection area and/or who have left the detection area are detected, and wherein a predefined general service profile is set as the service profile of the passengers.

4. The method according to claim 1, wherein the access rights of a passenger, who has arrived in the detection area, to locations served by the transport device in connection with the detection area are determined, and wherein an access control alarm is generated if the access right of the passenger to the one or more locations is not valid.

5. The method according to claim 1, wherein the access right of a passenger, who has left the detection area, to a location served by the transport device in connection with the detection area is determined, and wherein an access control alarm is generated if the access right of the passenger to the location is not valid.

6. A method for registering service requests in a conveying system, which comprises at least one transport device, and at least one detection area bounded on a floor surface, in which detection area the identification data contained in the personal identifiers of passengers can be read, wherein the method comprises the steps of:

reading the identification data contained in the identifiers of passengers in the detection area;

determining the service profiles of passengers who have arrived in the detection area and/or who have left the detection area on the basis of the identification data; and registering a service request according to the determined service profiles for transporting and/or admitting one or more passengers in the detection area to the location served by the conveying system, wherein the access rights of a superpassenger are set for a passenger to one or more locations served by the conveying system, and wherein the access of other passengers in the company of the passenger to the one or more locations is permitted on the basis of the access rights of the superpassenger.

7. A conveying system comprising:

a back-end system;

at least one transport device; and at least one detection area bounded on a floor surface of the at least one transport device, said detection area comprising a device configured to read and transmit, at least to the back-end system, the identification data of identifiers in the possession of passengers in the detection area, wherein the conveying system is arranged to determine the service profiles of passengers who have arrived in the detection area and/or who have left the detection area on the basis of the identification data, and to register a service request according to the service profiles for transporting and/or admitting one or more passengers to the location served by the conveying system.

8. The conveying system according to claim 7, wherein in connection with a transport device is at least one user interface, and wherein the back-end system is arranged to configure the user interface dynamically on the basis of the one or more service profiles.

9. The conveying system according to claim 7, wherein in connection with the detection area is a device configured to detect a passenger without an identifier who has arrived in the detection area and/or a passenger who has left the detection area, and wherein the back-end system is arranged to set a predefined general service profile as the service profile of the passengers.

10. The conveying system according to claim 9, wherein the back-end system is arranged to determine the access rights of a passenger, who has arrived in the detection area or left the detection area, to one or more locations served by the transport device, and to generate an access control alarm locally and/or in a remote monitoring center if the access right to the one or more locations is not valid.

11. The method according to claim 2, wherein passengers without an identifier who have arrived in the detection area and/or who have left the detection area are detected, and wherein a predefined general service profile is set as the service profile of the passengers.

12. The method according to claim 2, wherein the access rights of a passenger, who has arrived in the detection area, to locations served by the transport device in connection with the detection area are determined, and wherein an access control alarm is generated if the access right of the passenger to the one or more locations is not valid.

13. The method according to claim 3, wherein the access rights of a passenger, who has arrived in the detection area, to locations served by the transport device in connection with the detection area determined, and wherein an access control alarm is generated if the access right of the passenger to the one or more locations is not valid.

14. The method according to claim 2, wherein the access right of a passenger, who has left the detection area, to a location served by the transport device in connection with the detection area is determined, and wherein an access control alarm is generated if the access right of the passenger to the location is not valid.

15. The method according to claim 3, wherein the access right of a passenger, who has left the detection area, to a location served by the transport device in connection with the detection area is determined, and wherein an access control alarm is generated if the access right of the passenger to the location is not valid.

16. The method according to claim 4, wherein the access right of a passenger, who has left the detection area, to a location served by the transport device in connection with the detection area is determined, and wherein an access control alarm is generated if the access right of the passenger to the location is not valid.

17. The conveying system according to claim 8, wherein in connection with the detection area is a device configured to detect a passenger without an identifier who has arrived in the detection area and/or a passenger who has left the detection area, and wherein the back-end system is arranged to set a predefined general service profile as the service profile of the passengers.

* * * * *